US007653965B1

(12) United States Patent
Martynovych

(10) Patent No.: US 7,653,965 B1
(45) Date of Patent: Feb. 2, 2010

(54) SYSTEM AND METHOD FOR CARPET CLEANING

(76) Inventor: Alex Martynovych, 141 Buckelew Ave., Jamesburg, NJ (US) 08831

( * ) Notice: Subject to any disclaimer, the term of this patent is extended or adjusted under 35 U.S.C. 154(b) by 658 days.

(21) Appl. No.: 10/693,791

(22) Filed: Oct. 24, 2003

(51) Int. Cl.
*A47L 9/02* (2006.01)

(52) U.S. Cl. ..... 15/422.2; 15/320

(58) Field of Classification Search ..... 15/320–322, 15/326, 413, 422.2; *A47L 5/00, 9/02*
See application file for complete search history.

(56) References Cited

U.S. PATENT DOCUMENTS 4,651,380 A 3/1987 Ogden
4,800,612 A 1/1989 Valentine
5,099,543 A 3/1992 Wade
5,237,719 A 8/1993 Dwyer et al.
5,375,292 A 12/1994 Bailey
D364,947 S 12/1995 Kent et al.

*Primary Examiner*—David A Redding
(74) *Attorney, Agent, or Firm*—Porzio, Bromberg & Newman, P.C.

(57) ABSTRACT

A system and method for carpet cleaning for cleaning carpets along longer runs from a central tank and vacuum assembly while using less chemicals. The system and method for carpet cleaning includes a central tank and vacuum assembly, a wand assembly, and a hose assembly. The central tank and vacuum assembly facilitates the routing of clean and waste water and creates vacuum pressure for recapturing water applied to a carpet being cleaned. The wand assembly is designed for applying clean water to a carpet to be cleaned, and for recapturing the water in the form of waste water from the carpet. The hose assembly includes a first end operationally coupled to the central tank and vacuum assembly, and a second end operationally coupled to the wand assembly. The hose assembly is used to conduct water and waste water between the wand assembly and the central tank and vacuum assembly.

12 Claims, 6 Drawing Sheets

SYSTEM AND METHOD FOR CARPET CLEANING

BACKGROUND OF THE INVENTION

1. Field of the Invention

The present invention relates to carpet cleaning machines and more particularly pertains to a new system and method for carpet cleaning for cleaning carpets along longer runs from a central tank and vacuum assembly while using less chemicals.

2. Description of the Prior Art

The use of carpet cleaning machines is known in the prior art. More specifically, carpet cleaning machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,375,292; U.S. Pat. No. 5,099,543; U.S. Pat. No. 4,800,612; U.S. Pat. No. 4,651,380; U.S. Pat. No. 5,237,719; and U.S. Pat. No. Des. 364,947.

While these devices fulfill their respective, particular objectives and requirements, the aforementioned patents do not disclose a new system and method for carpet cleaning. The inventive device includes a central tank and vacuum assembly, a wand assembly, and a hose assembly. The central tank and vacuum assembly facilitates the routing of clean and waste water. The central tank and vacuum assembly creates vacuum pressure for recapturing water applied to a carpet being cleaned. The wand assembly is designed for applying clean water to a carpet to be cleaned. The wand assembly is also designed for recapturing the water in the form of waste water from the carpet. The hose assembly includes a first end and a second end. The first end is operationally coupled to the central tank and vacuum assembly. The second end is operationally coupled to the wand assembly. The hose assembly is used to conduct water and waste water between the wand assembly and the central tank and vacuum assembly.

In these respects, the system and method for carpet cleaning according to the present invention substantially departs from the conventional concepts and designs of the prior art, and in so doing provides an apparatus primarily developed for the purpose of cleaning carpets along longer runs from a central tank and vacuum assembly while using less chemicals.

SUMMARY OF THE INVENTION

In view of the foregoing disadvantages inherent in the known types of carpet cleaning machines now present in the prior art, the present invention provides a new system and method for carpet cleaning construction wherein the same can be utilized for cleaning carpets along longer runs from a central tank and vacuum assembly while using less chemicals.

The general purpose of the present invention, which will be described subsequently in greater detail, is to provide a new system and method for carpet cleaning apparatus and method which has many of the advantages of the carpet cleaning machines mentioned heretofore and many novel features that result in a new system and method for carpet cleaning which is not anticipated, rendered obvious, suggested, or even implied by any of the prior art carpet cleaning machines, either alone or in any combination thereof.

To attain this, the present invention generally comprises a central tank and vacuum assembly, a wand assembly, and a hose assembly. The central tank and vacuum assembly facilitates the routing of clean and waste water. The central tank and vacuum assembly creates vacuum pressure for recapturing water applied to a carpet being cleaned. The wand assembly is designed for applying clean water to a carpet to be cleaned. The wand assembly is also designed for recapturing the water in the form of waste water from the carpet. The hose assembly includes a first end and a second end. The first end is operationally coupled to the central tank and vacuum assembly. The second end is operationally coupled to the wand assembly. The hose assembly is used to conduct water and waste water between the wand assembly and the central tank and vacuum assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new system and method for carpet cleaning apparatus and method which has many of the advantages of the carpet cleaning machines mentioned heretofore and many novel features that result in a new system and method for carpet cleaning which is not anticipated, rendered obvious, suggested, or even implied by any of the prior art carpet cleaning machines, either alone or in any combination thereof.

It is another object of the present invention to provide a new system and method for carpet cleaning which may be easily and efficiently manufactured and marketed.

It is a further object of the present invention to provide a new system and method for carpet cleaning which is of a durable and reliable construction.

An even further object of the present invention is to provide a new system and method for carpet cleaning which is susceptible of a low cost of manufacture with regard to both materials and labor, and which accordingly is then susceptible of low prices of sale to the consuming public, thereby making such system and method for carpet cleaning economically available to the buying public.

Still yet another object of the present invention is to provide a new system and method for carpet cleaning which provides in the apparatuses and methods of the prior art some of the advantages thereof, while simultaneously overcoming some of the disadvantages normally associated therewith.

Still another object of the present invention is to provide a new system and method for carpet cleaning for cleaning carpets along longer runs from a central tank and vacuum assembly while using less chemicals.

Yet another object of the present invention is to provide a new system and method for carpet cleaning which includes a central tank and vacuum assembly, a wand assembly, and a hose assembly. The central tank and vacuum assembly facilitates the routing of clean and waste water. The central tank and vacuum assembly creates vacuum pressure for recapturing water applied to a carpet being cleaned. The wand assembly is designed for applying clean water to a carpet to be cleaned. The wand assembly is also designed for recapturing the water in the form of waste water from the carpet. The hose assembly includes a first end and a second end. The first end is operationally coupled to the central tank and vacuum assembly. The second end is operationally coupled to the wand assembly. The hose assembly is used to conduct water and waste water between the wand assembly and the central tank and vacuum assembly.

Another advantage of the present invention is the ability to provide a pressurized fresh water supply which is adjustable between 100 psi and 1200 psi.

Still yet another object of the present invention is to provide a new system and method for carpet cleaning that can use a cleaning wand coupled to a central tank and vacuum assembly via a hose having a length of 400 feet or less.

Even still another object of the present invention is to provide a new system and method for carpet cleaning that minimizes the chemical residue left after cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
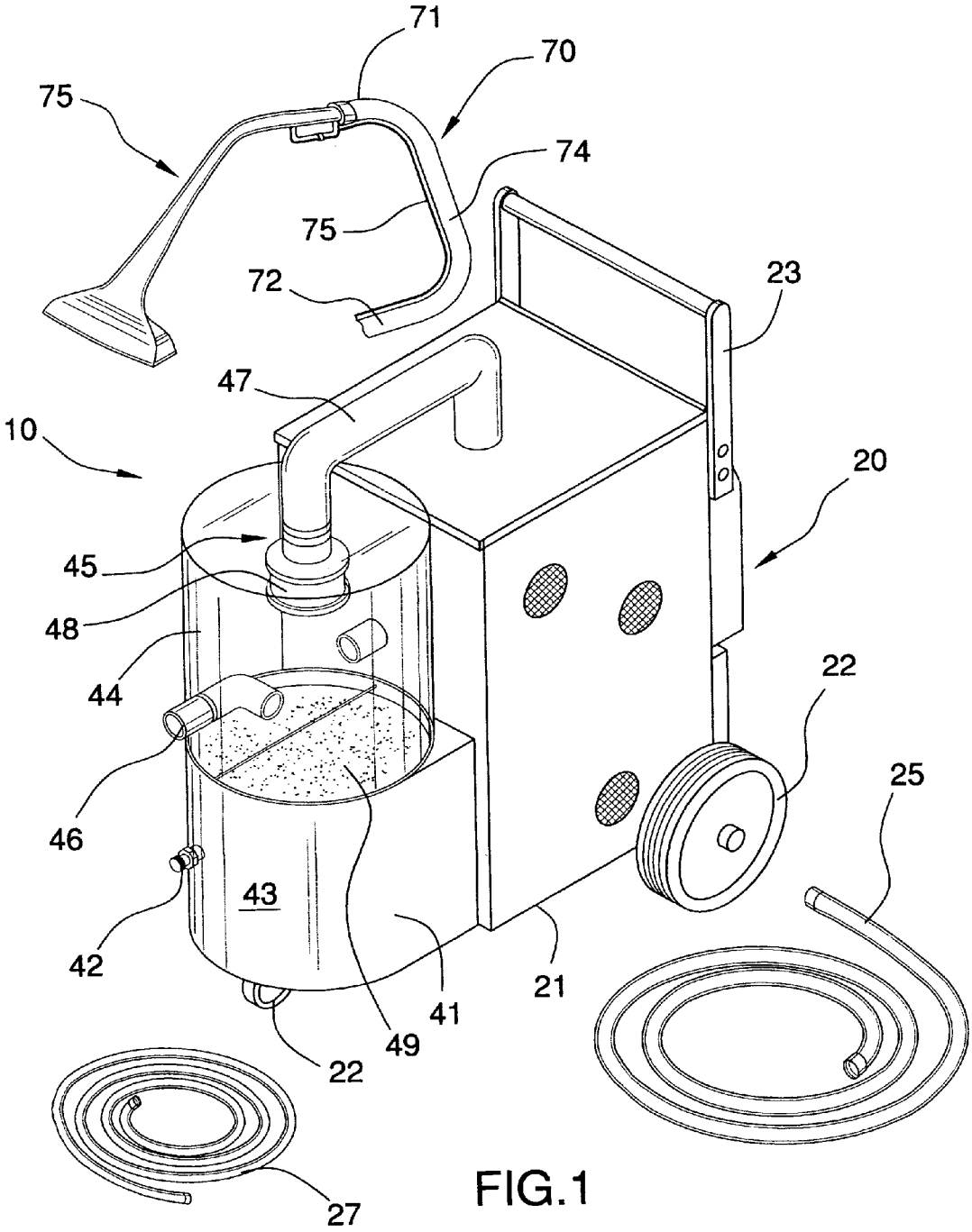
FIG. 1 is a schematic perspective view of a new system and method for carpet cleaning according to the present invention.
Figure 2:
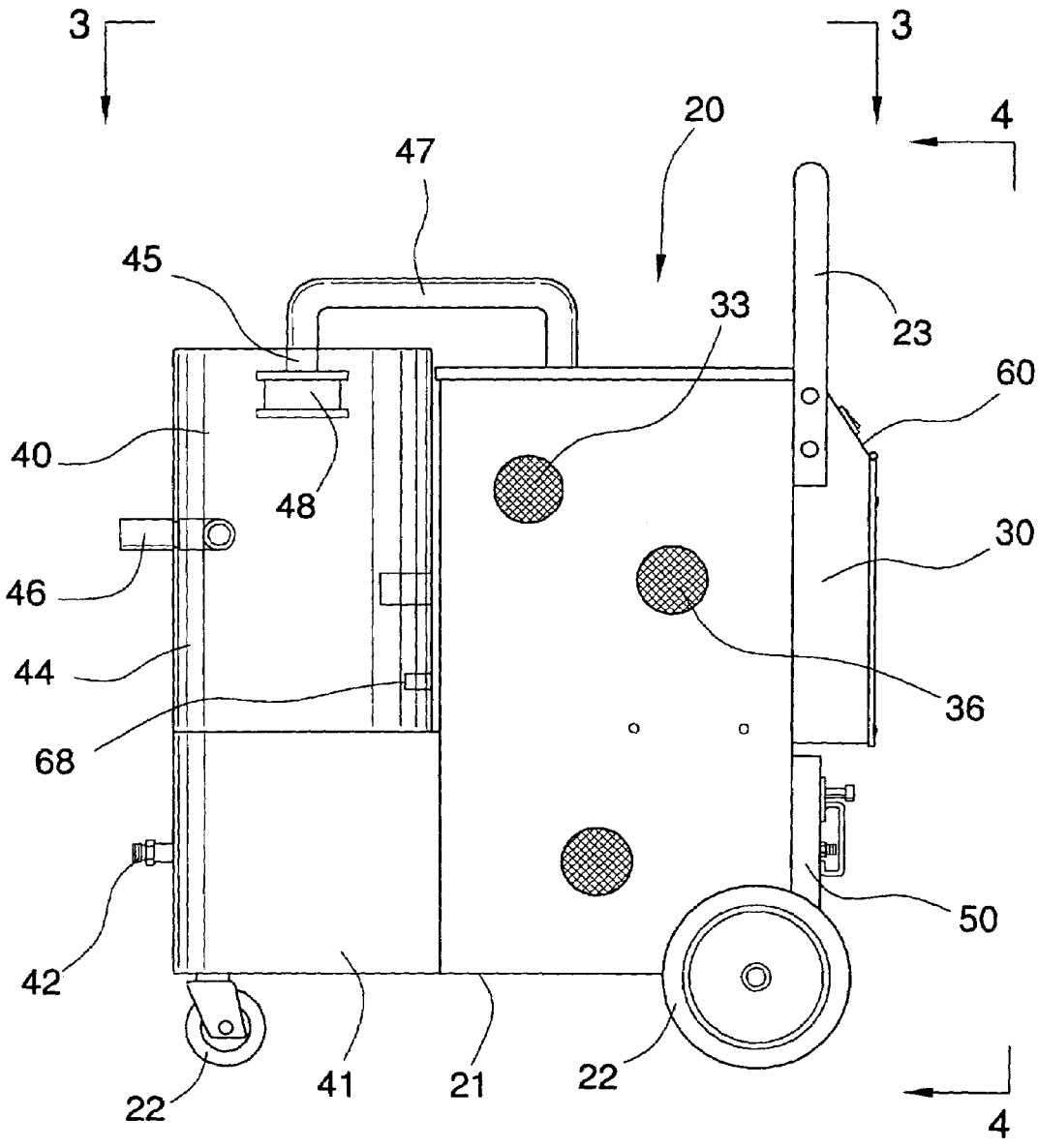
FIG. 2 is a schematic side view of the present invention.
Figure 3:
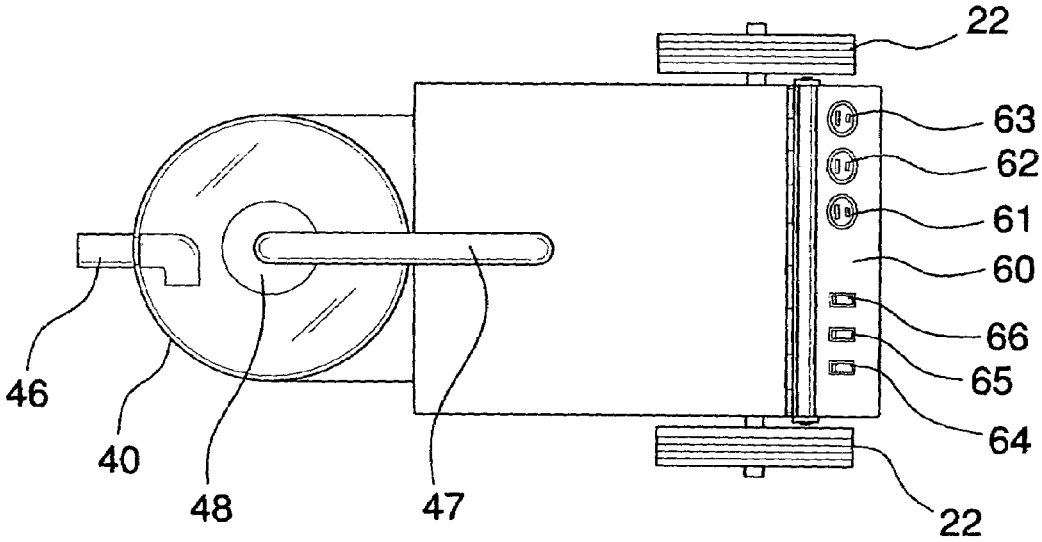
FIG. 3 is a schematic top view of the present invention.
Figure 4:
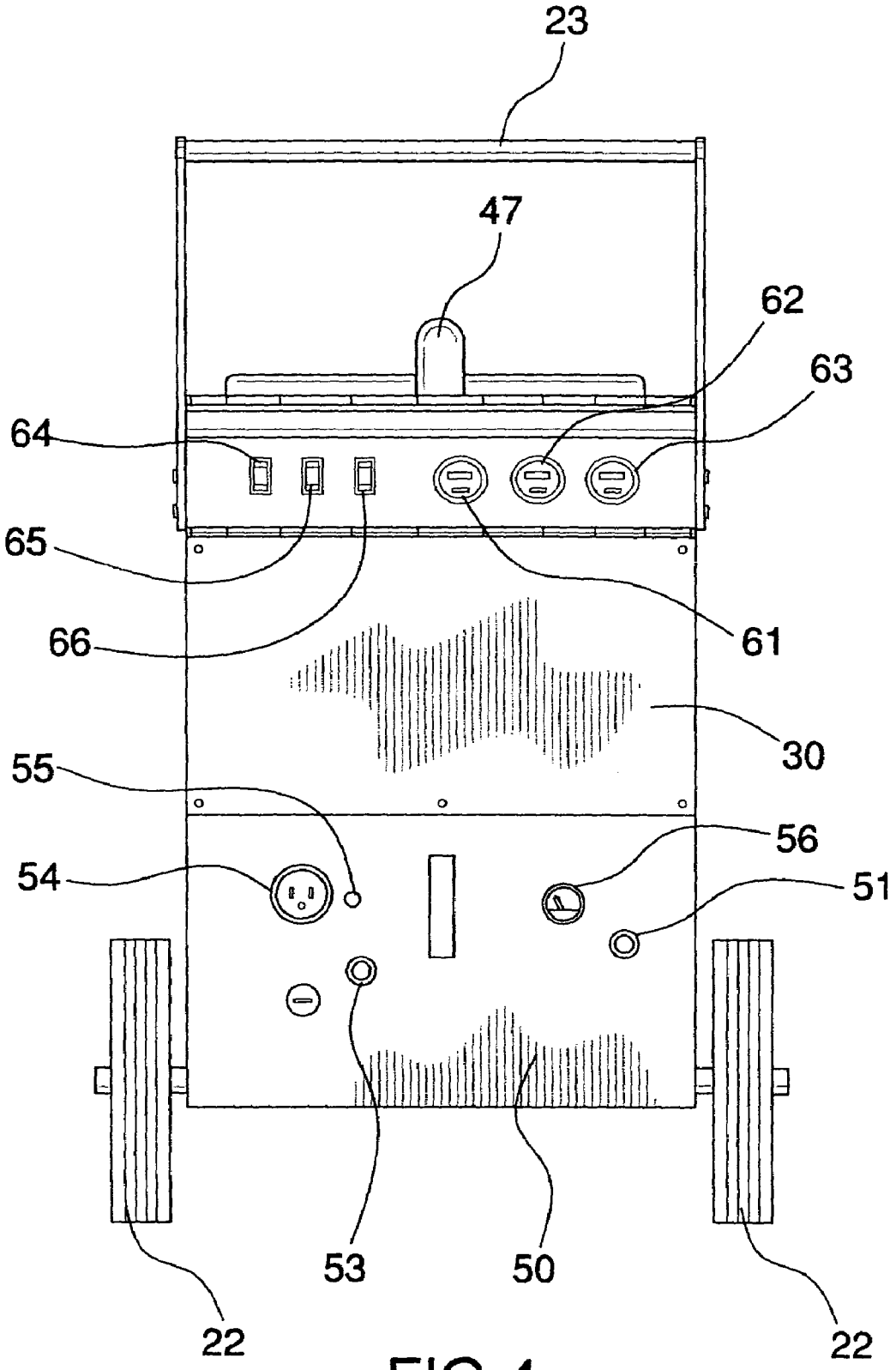
FIG. 4 is a schematic rear view of the present invention.
Figure 5:
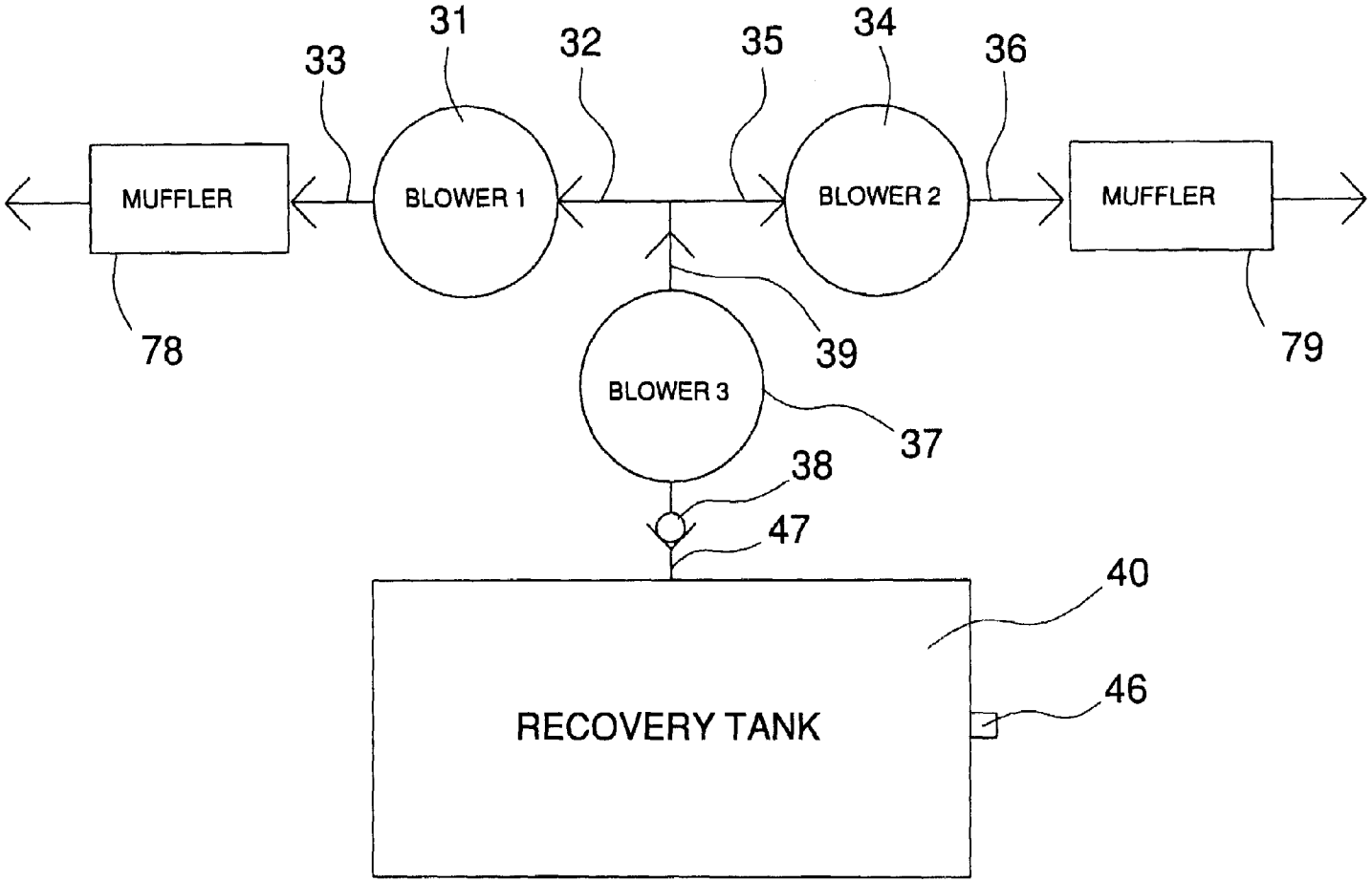
FIG. 5 is a schematic blower interconnect diagram of the present invention.
Figure 6:
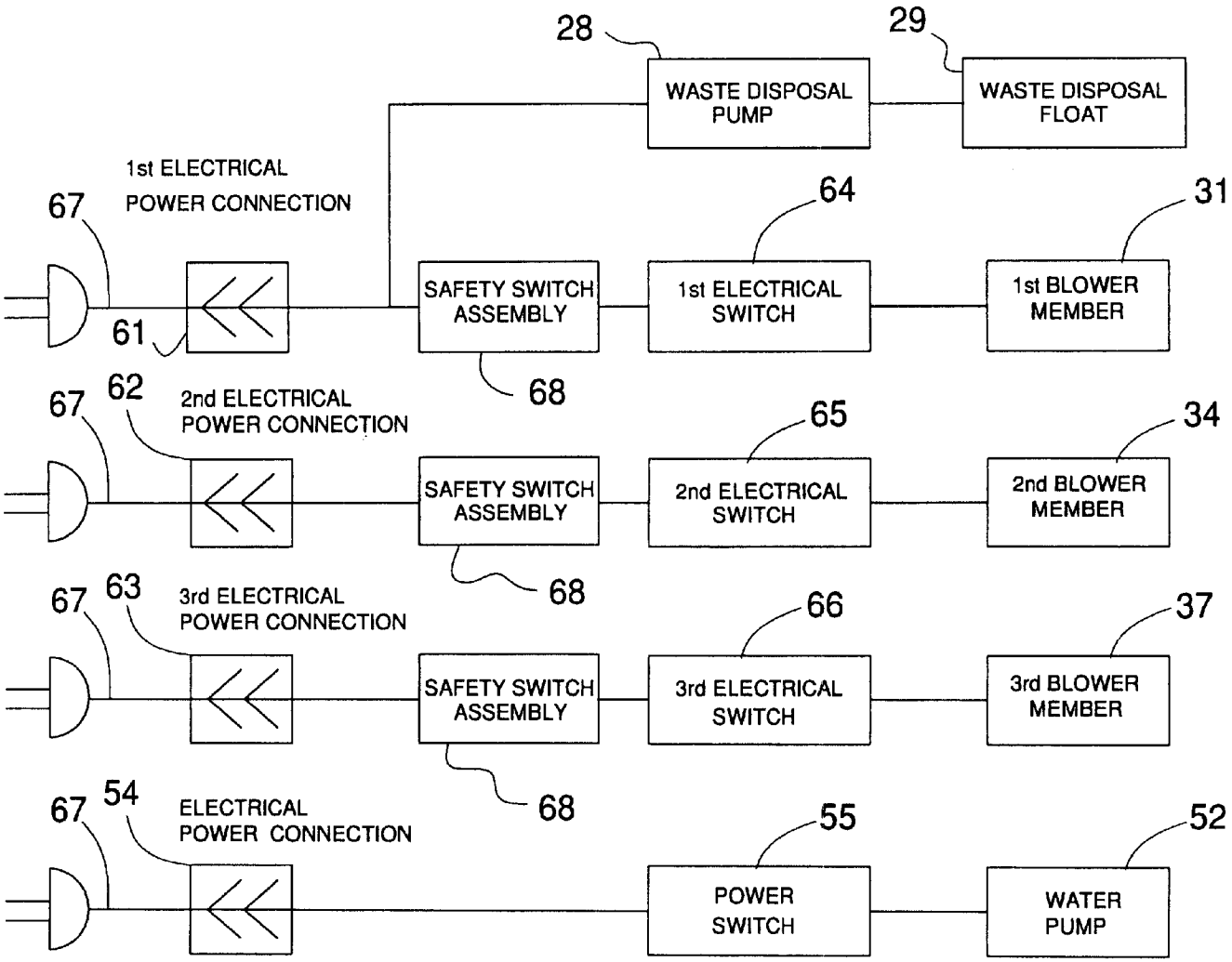
FIG. 6 is a schematic electrical interconnect diagram of the present invention.

With reference now to the drawings, and in particular to FIGS. 1 through 6 thereof, a new system and method for carpet cleaning embodying the principles and concepts of the present invention and generally designated by the reference numeral 10 will be described.

As best illustrated in FIGS. 1 through 6, the system and method for carpet cleaning 10 generally comprises a central tank and vacuum assembly 20, a wand assembly 75, and a hose assembly 70.

The central tank and vacuum assembly 20 facilitates the routing of clean and waste water. The central tank and vacuum assembly 20 creates vacuum pressure for recapturing water applied to a carpet being cleaned.

The wand assembly 75 is designed for applying clean water to a carpet to be cleaned. The wand assembly 75 is also designed for recapturing the water in the form of waste water from the carpet.

The hose assembly 70 includes a first end 71 and a second end 72. The first end 71 is operationally coupled to the central tank and vacuum assembly 20. The second end 72 is operationally coupled to the wand assembly 75. The hose assembly 70 is used to conduct water and waste water between the wand assembly 75 and the central tank and vacuum assembly 20.

In an embodiment the central tank and vacuum assembly 20 further comprises a chassis assembly 21, a vacuum assembly 30, a waste recovery assembly 40, and a water pressure assembly 50. The chassis assembly 21 includes a plurality of wheels 22 operationally coupled to a bottom side of the chassis assembly 21. The vacuum assembly 30 is positioned within the chassis assembly 21. The vacuum assembly 30 is for creating vacuum pressure for recapturing waste water. The waste recovery assembly 40 is operationally coupled to the vacuum assembly 30. The waste recovery assembly 40 provides a collection and separation means whereby recovered waste water is separated from air, which is routed to the vacuum assembly 30. The waste recovery assembly 40 rests upon the chassis assembly 21. The water pressure assembly 50 is preferably positionable inside the chassis assembly 21. The water pressure assembly 50 is for pressurizing water being routed to the wand assembly 75.

In a further embodiment the vacuum assembly 30 further comprises: a first 31, second 34 and third blower member 37. The first blower member 31 includes a first inlet 32 and a first outlet 33. The first blower assembly 31 is configured to create a vacuum at the first inlet 32 and exhaust air from the first outlet 33. The second blower member 34 includes a second inlet 35 and a second outlet 36. The second blower assembly 34 is configured to create a vacuum at the second inlet 35 and exhaust air from the second outlet 36. Preferably, the first 32 and second inlets 35 are coupled in parallel to increase airflow through the vacuum assembly 30. The third blower member 37 includes a third inlet 38 and a third outlet 39. The third blower assembly 37 is configured to create a vacuum at the third inlet 38 and exhaust air from the third outlet 39. Preferably, the third outlet 39 is operationally coupled to the first 32 and second inlets 35. Thus, the third blower member 37 is configured in series with a combination of the first 31 and second blower members 32. The third blower member 37 is coupled in series to increase vacuum pressure created by the vacuum assembly 30.

In still a further embodiment the waste recovery assembly 40 further comprises a lower tank portion 41, upper tank portion 44 and waste filter 49. The lower tank portion 41 is coupled to the chassis assembly 21. The lower tank portion 41 is for collecting waste water. The upper tank portion 44 is removably coupled to the lower tank portion 41. The upper tank portion 44 includes a vacuum inlet 45 operationally coupled to the vacuum assembly 30. The upper tank portion 44 also includes a hose connection 46 for operationally coupling to the hose assembly 70. The upper tank portion 44 is environmentally coupled to the lower tank portion 41. The lower tank portion 41 further comprises a waste disposal outlet 42 positioned through a wall 43 of the lower tank portion 41. The waste disposal outlet 42 facilitates flow of recovered waste water from the waste recovery assembly 40 to a waste drain. The upper tank portion 44 further comprises a vacuum connection tube 47 extending through the upper tank portion 44. The vacuum connection tube 47 includes a proximal end and a distal end. The distal end is couplable to an inlet 38 of the vacuum assembly 30. The proximal end extends into the upper tank portion 44. The proximal end includes a vacuum filter 48 attached thereto. The waste filter 49 is preferably positioned between the upper tank portion 44 and the lower tank portion 41. Thus, waste water collected in the waste recovery assembly 40 flows into the upper tank portion 44, through the waste filter 49 and into the lower tank portion 41. The waste filter 49 is removable from the waste recovery assembly 40 for cleaning after use.

In even still a further embodiment, the waste recovery assembly 40 includes a waste disposal pump 28, which is preferably positioned in the lower tank portion 41 under the waste filter 49. The waste disposal pump 28 is fluidly coupled to the waste disposal outlet 42 for pumping waste water out of the lower tank portion 41. Preferably, the waste disposal pump 28 has a waste disposal float 29 for detecting a level of waste water collected in the lower tank portion 41. The waste disposal float 29 activates the waste disposal pump 28 when the waste water located in the lower tank portion 41 reaches a predetermined level. While other level sensing devices may be employed, because of the debris and contamination present in the waste water, including cleaning solutions, the use of a float type mechanism is preferred.

In a further embodiment, the waste recovery assembly 40 further includes a safety switch assembly 68 for selectively interrupting the operation of the vacuum assembly 30 when waste water reaches a second predetermined level, which may indicate failure of the waste disposal pump 28.

Optionally, a secondary waste filter can be inserted in the hose connection 46 for capturing small debris from the waste water prior to the waste filter 49. Many different configurations of secondary waste filter may be used. However, a conventional knee-high stocking is preferred as it is a cost effective disposable solution which functions well in this task.

In yet a further embodiment the water pressure assembly 50 further comprises a fresh water inlet 51, a water pump 52, a pressurized water outlet 53, an electrical power connection 54, a power switch 55, and a pressure gauge 56. The fresh water inlet 51 extends through a wall of the water pressure assembly 50. The fresh water inlet 51 is operationally couplable to a water supply. The water pump 52 is positioned within the water pressure assembly 50 and operationally coupled to the fresh water inlet 51. The water pump 52 is for pressurizing the fresh water. The pressurized water outlet 53 extends through the wall of the water pressure assembly 50. The pressurized water outlet 53 is operationally coupled to the water pump 52. The electrical power connection 54 electrically coupled to the water pump 52. The electrical power connection 54 facilitates powering the water pump 52. The power switch 55 is electrically connected between the electrical power connection 54 and the water pump 52. The power switch 55 is for selectively connecting the water pump 52 to the electrical power connection 54 and selectively interrupting the connection. Thus, the water pump 52 is selectively turned on and off. The pressure gauge 56 is positioned on the wall of the water pressure assembly 50. The pressure gauge 56 is coupled to the pressurized water outlet 53. The pressure gauge 56 provides a visual indication of available water pressure.

The water pressure assembly 50 is preferably adjustable for controlling the pressure of the fresh water to the pressurized water outlet 53. Preferably the pressure is adjustable between 100 psi and 1200 psi to facilitate cleaning various types of surfaces. Normally, it is anticipated that the water pressure assembly 50 would be adjusted to provide a water pressure in the range of 400 psi to 700 psi inclusive for cleaning indoor carpeting, with 450 psi being a normal default setting. Additionally, the water pressure assembly 50 may be adjusted to provide 900 psi of pressure to the pressurized water outlet 53 to facilitate cleaning outdoor carpeting around chlorinated swimming pools. Further, the water pressure assembly may be adjusted to provide 100 psi for cleaning furniture.

An electrical connection assembly 60 is preferably coupled to the chassis assembly 21. The electrical connection assembly 60 facilitates routing of electrical power to the vacuum assembly 30.

In an embodiment the electrical connection assembly 60 further comprises a first 61, second 62, and third electrical power connection 63 and a first 64, second 65, and third electrical switch 66. The first electrical power connection 61 facilitates connection of the electrical connection assembly 60 to an electrical power source. The first electrical power connection 61 is positioned on a panel of the electrical connection assembly 60. The first electrical switch 64 is positioned on the panel of the electrical connection assembly 60. The first electrical switch 64 is connected between the first electrical power connection 61 and the first blower member 31. The first electrical switch 64 controls a flow of electricity from the first electrical power connection 61 to the first blower member 31. The second electrical power connection 62 facilitates connection of the electrical connection assembly 60 to an electrical power source. The second electrical power connection 62 is also positioned on a panel of the electrical connection assembly 60. The second electrical switch 65 is similarly positioned on the panel of the electrical connection assembly 60. The second electrical switch 65 is connected between the second electrical power connection 62 and the second blower member 34. The second electrical switch 65 controls a flow of electricity from the second electrical power connection 62 to the second blower member 34. The third electrical power connection 63 facilitates connection of the electrical connection assembly 60 to an electrical power source. The third electrical power connection 63 is positioned on a panel of the electrical connection assembly 60. The third electrical switch 66 is positioned on the panel of the electrical connection assembly 60. The third electrical switch 66 is connected between the third electrical power connection 63 and the third blower member 37. The third electrical switch 66 controls a flow of electricity from the third electrical power connection 63 to the third blower member 37.

In an embodiment, the vacuum assembly 30 develops 200 inches of water lift capability and 230 cfm of vacuum.

In yet a further embodiment, the vacuum assembly 30 may further include a pair of mufflers 78, 79. Each one of the mufflers is operationally coupled to an associated one of the first 33 and second outlets 36 for reducing the audible noise produced bay the vacuum assembly 30.

In a further embodiment the hose assembly 70 includes an overall length of 400 feet. The hose assembly 70 includes a water supply line 73 for routing water from the water pressure assembly 50 to the wand assembly 75. The hose assembly 70 also includes a waste return line 74 coupled to the waste recovery assembly 40 for routing waste water from the wand assembly 75 to the waste recovery assembly 40. The waste return line 74 has a diameter of 2 inches.

Preferably, the wand assembly has a vacuum inlet with a width of less than ¼ inch to facilitate suction of the waste water in the wand assembly even when the wand assembly is lifted from the carpet being cleaned. More preferably the width of the vacuum inlet is approximately $1/8^{th}$ of an inch.

A water supply hose 25 includes a first end and a second end. The first end is couplable to the fresh water inlet 51. The second end is couplable to a water supply.

A waste disposal line 27 includes a first and second end. The first end is couplable to the waste disposal outlet 42. The second end is positionable next to a water disposal drain.

Each one of a plurality of power cords 67 is associated with one of the electrical power connections 54, 61, 62, 63. Each one of the power cords 67 includes a first end couplable with a conventional electrical outlet. Each one of the power cords 67 also includes a second end couplable with an associated one of the electrical power connections 54, 61, 62, 63.

A handle member 23 is preferably coupled to the chassis assembly 21 for facilitating positioning of the system 10.

In use, a pre-treat chemical for breaking up stains on a carpet to be cleaned is provided. The pre-treat chemical is applied to the carpet to be cleaned. A water supply hose having a first and second end is provided. The first end is couplable to the fresh water inlet and the second end being couplable to a water supply. The first end is connected to the fresh water inlet. The second end is connected to the water supply. The first end of the hose assembly is connected to the central tank and vacuum assembly. The second end of the hose assembly is connected to the wand assembly. A waste disposal line having a first and second end is provided. The first end of the waste disposal line is connected to the waste recovery assembly. The second end of the waste disposal line is placed in a toilet. The system is connected to an electrical power supply. The water supply is turned on, preferably using hot water. The wand assembly is positioned at a first end of the carpet to be cleaned. Fresh water is applied through the wand assembly to a small area of the carpet to rinse the pre-treat chemical from the carpet. The water and pre-treat chemical are removed as waste water from the small area of the carpet. The user then moves to an adjacent small area of the carpet and repeats the above process steps until an entirety of the carpet has been treated and rinsed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carpet cleaning system for use over long runs comprising:

a central tank and vacuum assembly facilitating the routing of clean and waste water, said central tank and vacuum assembly being for creation of vacuum pressure for recapturing water applied to a carpet being cleaned;

a wand assembly adapted for applying clean water to a carpet to be cleaned, said wand assembly being adapted for recapturing said water in the form of waste water from the carpet;

a hose assembly having a first end and a second end, said first end being operationally coupled to said central tank and vacuum assembly, said second end being operationally coupled to said wand assembly, said hose assembly being for conduction water and waste water between said wand assembly and said central tank and vacuum assembly;

said vacuum assembly comprising a first blower member having a first inlet and a first outlet, said first blower assembly being configured to create a vacuum at said first inlet and exhaust air from said first outlet; a second blower member having a second inlet and a second outlet, said second blower assembly being configured to create a vacuum at said second inlet and exhaust air from said second outlet, said first and second inlets being coupled in parallel to increase airflow through said vacuum assembly; and a third blower member having a third inlet and a third outlet, said third blower assembly being configured to create a vacuum at said third inlet and exhaust air from said third outlet, said third outlet being operationally coupled to said first and second inlets, said third blower member being configured in series with a combination of said first and second blower members being coupled in parallel;

wherein said third blower member being coupled in series to increase vacuum pressure created by said vacuum assembly.

2. The system of claim 1, wherein said central tank and vacuum assembly further comprises:

a chassis assembly having a plurality of wheels operationally coupled to a bottom side of said chassis assembly;

said vacuum assembly positioned within said chassis assembly, said vacuum assembly being for creating vacuum pressure for recapturing waste water;

a waste recovery assembly operationally coupled to said vacuum assembly, said waste recovery assembly providing a collection and separation means such that recovered waste water is separated from air being routed to said vacuum assembly, said waste recovery assembly resting upon said chassis assembly; and a water pressure assembly positionable inside said chassis assembly, said water pressure assembly being for pressurizing water being routed to said wand assembly.

3. The system of claim 2, wherein said waste recovery assembly further comprises:

a lower tank portion coupled to said chassis assembly, said lower tank portion being for collecting waste water;

an upper tank portion removably coupled to said lower tank portion, said upper tank portion having a vacuum inlet operationally coupled to said vacuum assembly, said upper tank portion having a hose connection for operationally coupling to said hose assembly;

said upper tank portion being environmentally coupled to said lower tank portion.

4. The system of claim 3, wherein said lower tank portion further comprises a waste disposal outlet positioned through a wall of said lower tank portion, said waste disposal outlet facilitating flow of recovered waste water from said waste recovery assembly to a waste-drain.

5. The system of claim 3, wherein said upper tank portion further comprises a vacuum connection tube extending through said upper tank portion, said vacuum connection tube having a proximal end and a distal end, said distal end being couplable to an inlet of said vacuum assembly, said proximal end extending into said upper tank portion, said proximal end having a vacuum filter attached thereto.

6. The system of claim 3, wherein said waste recovery assembly further comprises a waste filter positioned between said upper tank portion and said lower tank portion whereby waste water being collected in said waste recovery assembly flows into said upper tank portion, through said waste filter and into said lower tank portion, said waste filter being removable from said waste recovery assembly for cleaning after use.

7. The system of claim 2, wherein said water pressure assembly further comprises:

a fresh water inlet extending through a wall of said water pressure assembly, said fresh water inlet being operationally couplable to a water supply;

a water pump positioned within said water pressure assembly and operationally coupled to said fresh water inlet, said water pump being for pressurizing the fresh water; and a pressurized water outlet extending through said wall of said water pressure assembly, said pressurized water outlet being operationally coupled to said water pump.

8. The system of claim 7, wherein said water pressure assembly further comprising:

an electrical power connection electrically coupled to said water pump, said electrical power connection facilitating powering said water pump;

a power switch electrically connected between said electrical power connection and said water pump, said power switch being for selectively connecting said water pump to said electrical power connection and selectively interrupting said connection whereby said water pump is selectively turned on and off;

a pressure gauge positioned on said wall of said water pressure assembly, said pressure gauge being coupled to said pressurized water outlet, said pressure gauge providing a visual indication of available water pressure.

9. The system of claim 3, further comprising:

a waste disposal pump positioned in said lower tank portion, said waste disposal pump being fluidly coupled to a waste disposal outlet for pumping waste water out of the lower tank portion; and a waste disposal float operationally coupled to said waste disposal pump, said waste disposal float activating said waste disposal pump when waste water reaches a predetermined level in said lower tank portion.

10. The carpet cleaning system of claim 1 wherein said hose assembly having a waste return line coupled to said waste recovery assembly for routing waste water from said wand assembly to said waste recovery assembly, said waster return line having a diameter of 2 inches.

11. The carpet cleaning system of claim 1 wherein said hose assembly has an overall length of 400 feet.

12. The carpet cleaning system of claim 1 wherein said vacuum assembly develops 200 inches of water lift capability and 230 cfm of vacuum.

* * * * *